United States Patent [19]

Uhlig et al.

[11] 4,368,820

[45] Jan. 18, 1983

[54] APPARATUS FOR SORTING ELECTRICAL CONTACT PIECES

[75] Inventors: Herbert K. Uhlig, Bainbridge; August M. Zegelbrier, Harpursville, both of N.Y.

[73] Assignee: The Bendix Corporation, Southfield, Mich.

[21] Appl. No.: 277,760

[22] Filed: Jun. 26, 1981

[51] Int. Cl.[3] ..... B07C 5/02

[52] U.S. Cl. ..... 209/540; 209/658; 209/691; 209/940

[58] Field of Search ..... 209/606, 634, 635, 656, 209/658, 691, 695, 940, 680, 540, 689

[56] References Cited

U.S. PATENT DOCUMENTS

| | | | |
|---|---|---|---|
| 4,024,058 | 5/1977 | Derckx | 209/680 |
| 4,171,747 | 10/1979 | Metzger et al. | 209/658 |
| 4,185,746 | 1/1980 | Fegan, Jr. | 209/691 |
| 4,341,311 | 7/1982 | Gold et al. | 209/658 |

FOREIGN PATENT DOCUMENTS

| | | | |
|---|---|---|---|
| 578124 | 10/1977 | U.S.S.R. | 209/656 |

*Primary Examiner*—Allen N. Knowles

*Attorney, Agent, or Firm*—Charles D. Lacina; Raymond J. Eifler

[57] ABSTRACT

An apparatus (100) and method for sorting a batch (200) of electrical contact pieces (11, 11') into two groups. The apparatus is characterized by a tiltable frame (72) concentrically mounting an assembly of a rotatable circular table (74) in spaced relation to a platform (80) having a radial wall (82) of less diameter than the table (74) to define an opening (86) therebetween. The circular table (74) includes an annulus sized to receive contacts. A guide arrangement (46) including a pair of guide members (50, 52) allows the contacts to pass to the rotating annulus, the good contacts rolling between the opening and through central holes in the table and the bad contacts rotating around and being scraped from the annulus.

19 Claims, 7 Drawing Figures

FIG. 6
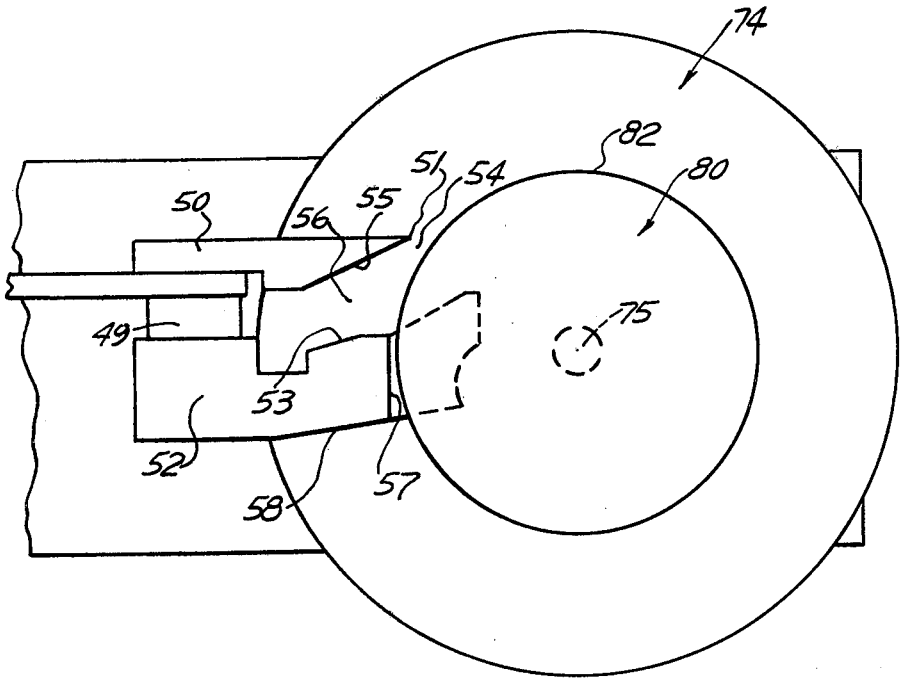
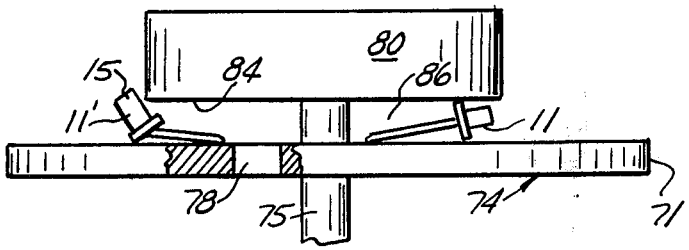
FIG. 7

APPARATUS FOR SORTING ELECTRICAL CONTACT PIECES

This invention relates to an apparatus for sorting electrical contact pieces and more particularly to an arrangement whereby a rotating table separates a batch of electrical contact pieces into a first group of undeformed pieces which are ready for further assembly and also into a second group of pieces which are deformed and which can be recycled.

In the automatic manufacture of the electrical connectors and the like apparatus, certain components must be assembled. For electrical contacts of the "brush-type" as disclosed in U.S. Pat. No. 3,725,844 to McKeown et al issuing Apr. 3, 1973, a plurality of straight wires are assembled with conductive contact pieces having coaxially aligned body portions. For this contact to be economical, these contact pieces and wires are assembled by high speed assembly machines. In view of close tolerances typically maintained in high speed assembly machines, unless the quality of a presented workpiece is not controlled, an assembler risks jamming and/or possibly damaging the assembly machine by using deformed pieces. As a result of its manufacture, a contact piece is not always straight and can include bent or deformed portions or have metal chips. Accordingly, for speed of assembly and for protection of the assembly machine, the assembler would desire for any given batch of contact pieces that those contact pieces having bent or deformed portions be separated from the other unbent and otherwise undeformed pieces.

In the past, visual inspection among other techniques have been employed to determine the presence of bent or eccentrically aligned portions of the contact piece. These methods, have not proved satisfactory. For one thing, visual approach is time consuming and tedious without adequate assurance that separated contact pieces have eliminated all of the defective pieces. An assembler cannot be expected to visually detect misalignment angles of about 3° or miniscule chips on a mass assembly basis.

In order to alleviate this problem, it is desirable that a testing apparatus be provided which is inexpensive, simple in design, but yet capable of rapidly, yet accurately sorting damaged contact pieces from undamaged contact pieces so that undamaged pieces can be provided with certainty for use by a contact assembly machine and the damaged contact pieces discarded for recycling.

DISCLOSURE OF THE INVENTION

Accordingly, a simple yet effective apparatus is provided to reduce time spent in sorting deformed from undeformed electrical contact pieces, each contact piece being of the type having axially extending body portions and including a head (socket), a medial collar and tail (stem) portions, each of the undeformed contact pieces being chip free and having its body portions coaxially aligned.

In one embodiment, according to this invention, the apparatus for sorting damaged electrical contact pieces from a batch of such contact pieces is characterized by: a circular table having a flat, inclined, tabletop rotatably mounted at its center to the frame and having at least one partially annular hole adjacent the table center; a circular platform having a radial wall and having a flat bottom surface concentrically mounted in parallel spaced apart relation to the tabletop a sufficient distance to define an opening sized to pass the undeformed contact pieces, and a prime-mover for rotating the table about its axis, the diameter of the circular platform being less than that of the circular table so as to expose an annulus on the tabletop. A guide means for guiding the contact pieces onto the tabletop annulus includes a pair of spaced guide members defining a guide channel therebetween and a guide (supply) tube for discharging the contact pieces stem first onto the tabletop annulus with an impetus toward the center. One guide member has an inward end spaced from the radial wall to define a passage sized to pass the pieces presented to the tabletop. The other guide member has an inward end adjacent to the radial wall appropriately sized to prohibit pieces from passing therebetween and a sidewall adapted to scrape the deformed contact pieces from the tabletop annulus, whereby as the inclined table rotates the undeformed contact pieces pass through the opening between the tabletop and platform to fall through the annular hole of the tabletop and the deformed contact pieces are rotated from the first to the second guide to be scraped over the rim of the table by the sidewall.

Further and in accord with the invention is provided an ejector apparatus for supplying contact pieces, one at a time, for use with the sorter apparatus. In a preferred embodiment, a pair of spaced guide fingers define therebetween a slanted guideway which, when reciprocated horizontally, will cause one guide finger to engage the body of one contact piece, push the contact piece into the slanted guideway and cam the contact therethrough for presentation to the inlet end of the (supply) tube.

BRIEF DESCRIPTION OF THE DRAWINGS

FIG. 6 is a detail view of contact piece guide apparatus.

FIG. 7 is a view of contact pieces being sorted.

DETAILED DESCRIPTION OF THE INVENTION

Figures 1, 2, 3:
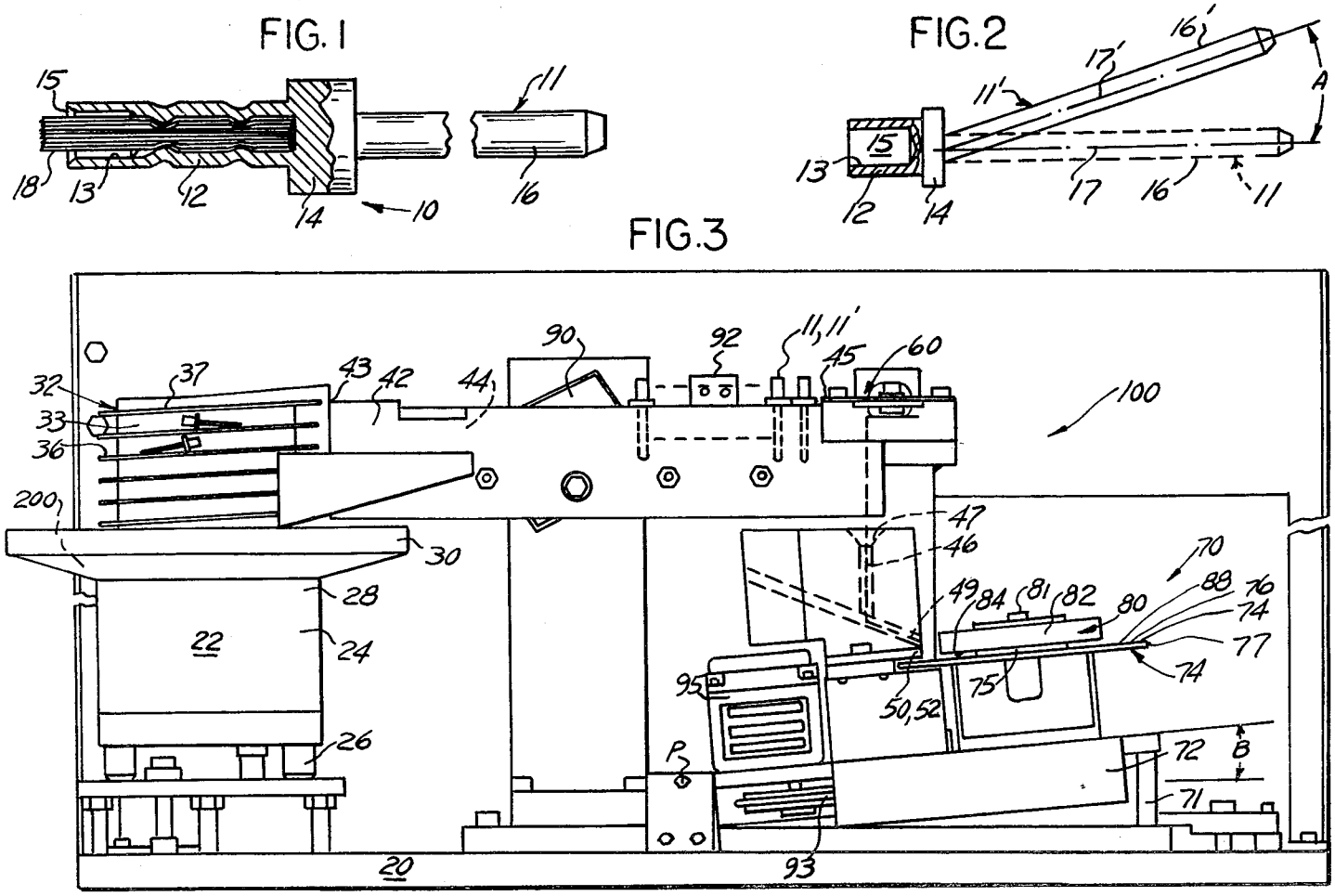
FIG. 1 is an enlarged view, partially in section, of an assembled "brush-type" electrical contact.
FIG. 2 is an enlarged view of a contact piece of the assembled contact of FIG. 1 that is to be sorted by an apparatus according to the present invention.
FIG. 3 is a front elevation view of a contact sorting apparatus according to the invention.

Referring now to the drawings, FIG. 1 illustrates an enlarged view, partially in section, of a hermaphroditic "brush-type" electrical contact 10 as disclosed by the aforesaid U.S. Pat. No. 3,725,844 and comprises a contact piece characterized by an elongated body 11 having coaxially aligned body portions and including a forward head 12, a medial collar 14 and a rearward tail 16, the head portion being provided with an axial passage 13 to define a socket 15. The socket 15 is designed to receive and secure like ends of a plurality of axial conductive wires 18 into "brush" form, the other like ends being exposed for mating.

FIG. 2 shows the contact piece 11 which comprises the medial collar 14, the forward head 12 (including the socket 15) extending axially forwardly of the medial collar and the tail (an elongated cylindrical stem) 16 extending axially rearwardly of the medial collar. The collar, socket and stem portions of an undeformed contact piece 11 are generally coaxially aligned along the primary axis 17 of the piece. In a typical contact piece the head outside diameter is about 0.039 inches and the head inside diameter (i.e., socket) is about 0.0275 inches (for a wall thickness of about 0.10 inches), the passage (socket) having a depth of about 0.076 inches. The medial collar 14 is generally cylindrical and has a diameter of about 0.058 inches and a width of about 0.0140 inches. The undeformed stem 16 is shown in phantom and a deformed contact piece 11' includes the stem 16' having its axis 17' bent at an angle "A" to the body axis 17 of the undeformed piece. The elongated stem 16 is adapted to be used in circuit board applications and, relative to the collar, the stem axial extension can be from two times to as much as seven times the axial extension of the socket. The inner diameter forming the socket is typically equal to or greater than an outer diameter of the stem (typically 0.021 inches), thereby providing the contact piece with an inherent difference in mass (inertia) distribution. The stem portion is heavier than the head portion. This mass distribution causes the stem portion to have a different mass moment of inertia than the mass movement of inertia of the socket portion. The contact piece mass movement of inertia taken about the end of the stem, and transverse to the contact piece axis, provides a complex dynamical motion.

When the above-type contact piece is placed on a horizontal table, due to geometry and mass distribution of the contact piece, an edge of the medial retention collar 14 and the distal free end of the stem will contact the table and the central axis of the contact piece will be inclined at a small angle relative to the table. If the table were to be inclined relative to the horizon, an undeformed (i.e., good) contact piece 11 will undergo a small angular rotation (i.e., the stem end will act as a pivot and the collar will roll relative thereto) and, possibly undergo a small downward displacement (e.g., slide) depending on the friction acting between the contact piece and the table. As a result of the table being inclined, one also observes that the central axis of the contact piece is oriented such that the free end of the stem is pointing upwardly and the socket end is pointing downwardly (i.e., the contact piece axis is vertical to the horizon). If the angle of inclination of the table is further increased, the frictional force will be exceeded and the contact piece will slide downwardly and from the table. However, and for the first situation of the table being given small angles of inclination relative to the horizon, if the table were also to be given a small rigid body rotation, the contact piece could vertically rise somewhat, thereby resulting in the axis of the contact piece not being disposed with the stem pointing upwardly and the socket pointed downwardly. The central axis of the contact piece would be out of alignment with the vertical but due to mass and inertia would again tend to right itself by some rolling and by some sliding. Continuing additional rigid body rotation of the table would continue these rolling and sliding oscillations of the contact piece and the contact piece would ultimately slide from the table. If the table had central openings, these pieces could fall therethrough.

On the other hand, a deformed (i.e., bent) contact piece 11' will have the tendancy to merely flip-flop in place and slide downwardly somewhat but not roll (i.e., pivot about its stem). Chips and burrs on the contact piece will also inhibit rolling action. As such, for these small table inclinations and table rotations, these bent contact pieces could possibly complete a full rotation of the table unless somehow wiped-off. Studies have shown that the rate at which the table rotates is an important factor. If the table rate of rotation were too high, both good and bad contacts would be spun off. Preferably and in accord with this invention, studies have shown that a table rotation of as much as 20 rev/min would work, about 15.5 rev/min would work best.

In FIG. 2, the phantom lines extending from the medial collar 14 show an elongated stem 16 of an undeformed contact piece 11 and the solid lines show the stem portion 16' of the deformed contact piece 11' which could flip-flop. Due to body portions not being coaxially aligned, although the end of the stems 16, 16' and the collar edge will still contact the table substantially as before, the forwardmost end of the head (socket) of a deformed contact piece 11' will now vertically rise from the table somewhat more so than would the head of a good contact piece 11 having axially aligned contact portions. This fact is used to advantage in the sorting apparatus of this Application.

FIG. 3 illustrates an elevation view of an apparatus 100 according to the present invention for sorting straight and deformed electrical contact pieces 11, 11' from a batch 200 (not shown) of contact pieces. The apparatus for sorting 100 comprises a base 20, holding means 22 supported by the base for holding the batch 200 of contact pieces, a separator assembly 70 tiltably connected about a pivot "P" to the base for separating the damaged and undamaged contact pieces and guide means 40 for feeding the contact pieces from the holding means 22 to the separator assembly 70.

The holding means 22 includes a pedestal 24 having a bottom portion 26 mounted to the base 20 and a top portion 28 extending upwardly therefrom and a bowl 30 mounted to the top of the pedestal and adapted to receive the batch 200 of contact pieces to be sorted. The bowl 30 comprises a drum 32 including a cylindrical wall portion 33 and a helical shelf 36 advancing outwardly about the cylindrical wall from the bottom to the top of the drum, one of the helix ends 37 defining a workpiece discharge station. Vibrating means 38 vibrate the bowl 30 to advance the contact pieces upwardly from the bowl and to the top of the helix to be discharged to the guide means 40.

The guide means 40 comprise guide bars 42 defining a guide track 44 for receiving the contact pieces 11, 11' a guide tube 46 having inlet and outlet end portions 47, 49 respectively for receiving and for directing the pieces to the separator assembly 70 and a pair of guide members 50, 52 (see FIG. 6). The guide track 44 extends across the top surface of and between inlet and outlet ends 43, 45 of the guide bars 42, the inlet end 43 of the guide track 44 being disposed adjacent the helix discharge station 37 for receiving contact pieces discharged therefrom. Due to their weight imbalance, the contact pieces are oriented in side-by-side relation in the track with their sockets up (i.e., stems 16, 16' facing down in the guide track).

An agitator 90 disposed between the ends of the guide bars 42 vibrates the bar and causes the contact pieces to move across the guide track. A workpiece scanner 92, cooperatively associated with the vibrator 38, monitors back-up of workpieces in the guide track and adjusts the amount of vibration to maintain minimum quantities on the guide track.

Figure 4:
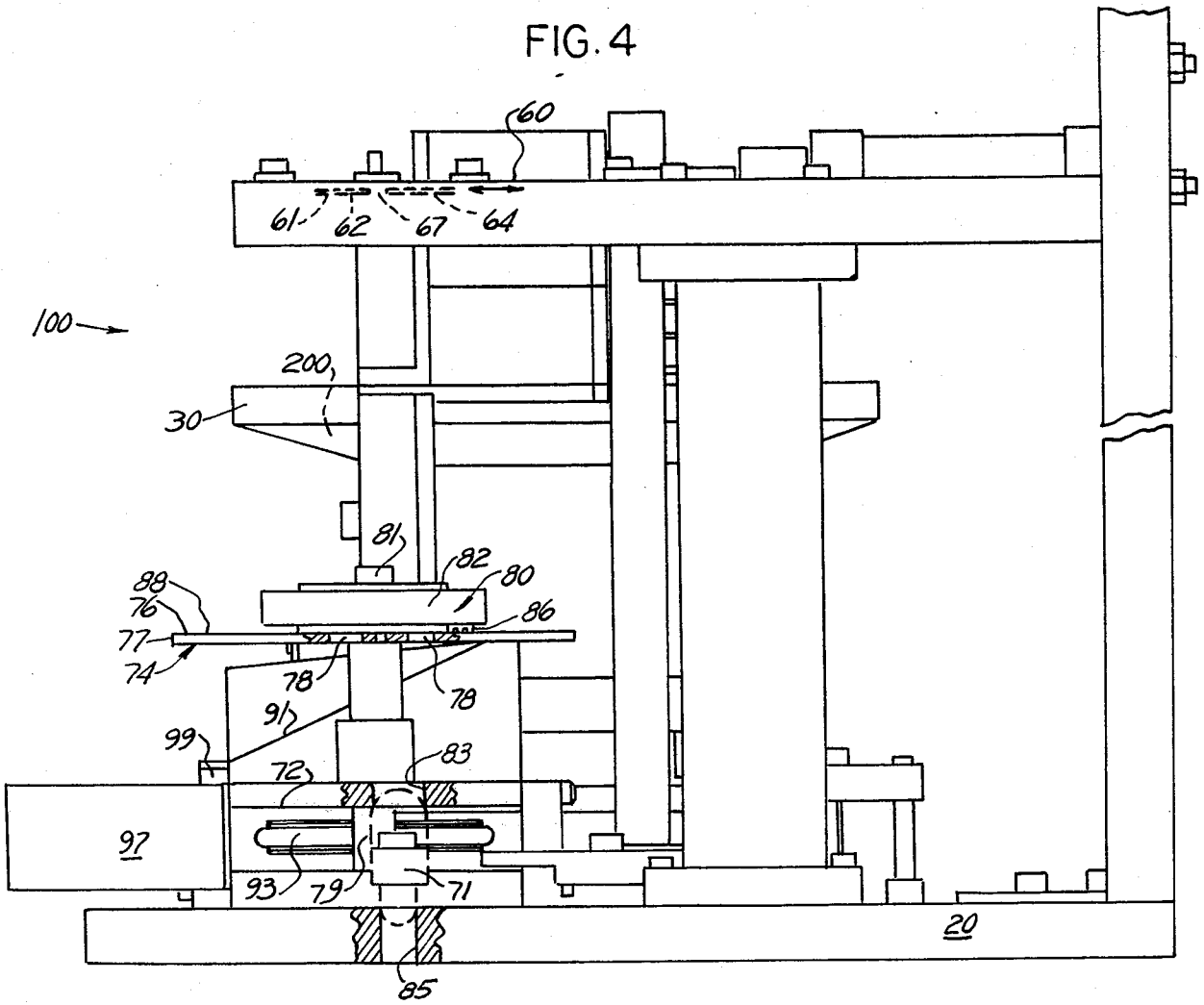
FIG. 4 is an end elevation view of the contact sorting apparatus of FIG. 3.
Figure 5:
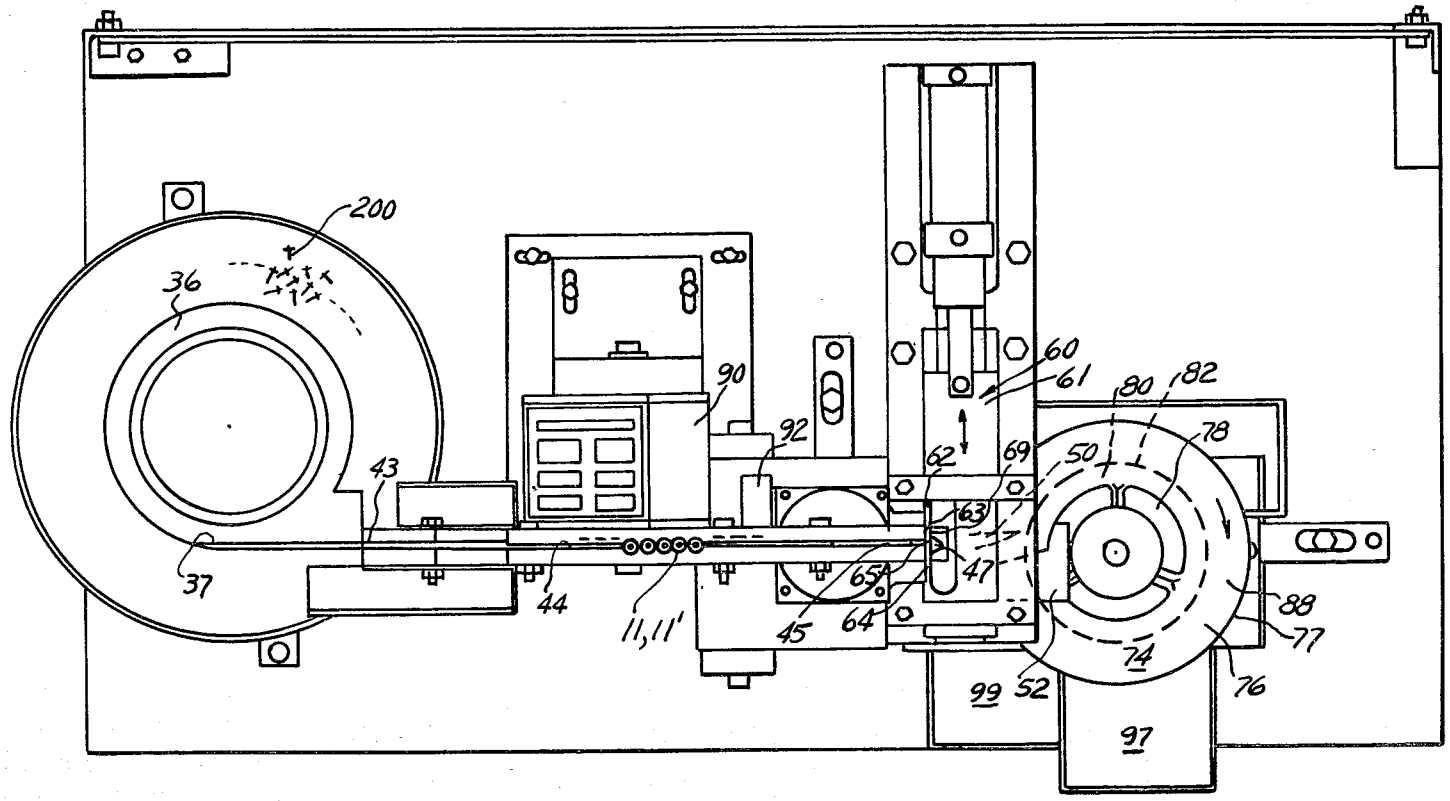
FIG. 5 is a plan view of the contact sorting apparatus of FIG. 3.

Although shown best in FIGS. 4 and 5, a workpiece ejector 60 is interposed between the outlet end (discharge station) 45 from said guide track 44 and the inlet 47 to the guide tube 46. The workpiece ejector comprises an ejector plate 61 (not shown) mounted for substantially horizontal reciprocation between first and second positions to engage and to push a single workpiece from the outlet end (discharge station) 45 of the feeder track 44 and into the inlet of the guide (supply) tube 46.

The separator assembly 70 comprises a support frame 72 tiltably connected to the base 20; a first substantially circular table 74 rotatably mounted at its center 75 to the support frame, the table having a flat tabletop 76, an outer rim 77 and including a plurality of centrally disposed holes 78 or cut-out regions (shown best in FIG. 5); a second substantially circular platform 80 (or table) mounted above the top surface (tabletop 76) of the table 74 with its center 81 concentric with the axis of rotation of the table, the platform 80 having a radial wall 82 and a flat bottom surface 84 mounted in substantially parallel spaced apart relation above the tabletop to define a uniform opening 86 therebetween, the platform 80 diameter being less than that of the tabletop 76 so as to expose an annulus 88 on the tabletop 76 between the outer rim 77 and the radial wall 82 and a prime mover 94 connected to the support frame for rotating the table 74 about its axis.

Preferably the cut-out regions 78 comprise a pair of arcuate annular openings. The prime mover comprises a motor 95 secured to the support frame 72 and mechanically connected by a drive belt 93 to a shaft 79 (not shown) which drives the flat circular table 74. The opening 86 between the tabletop and platform bottom surface is sized to be slightly greater than the distance that the socket end of an undeformed contact piece extends from the tabletop but less than the distance that the socket end of a deformed contact piece entends from the tabletop (see FIG. 7).

Also shown in FIG. 3, is the pivot point "P" and an angle "B" showing the inclination of the support frame 72 (mounting the table and the platform) relative to the horizon. A tilt angle of about 5% has been found to be suitable.

FIG. 4 is an end view of the apparatus 100 and shows the leading contact piece 11, 11' of the train of side-by-side contact pieces and the ejector member 60 in phantom to illustrate the horizontal reciprocation of the ejector plate 61. First and second means for collecting 96, 98, respectively, good and bad contact pieces are provided and are represented by first and second boxes 97, 99. A slide surface 91 presents the good contacts dropped from the holes 78 to the first collecting box 97. The second means supplies the bad contacts scraped from the rim 77 of table 74 to the second collecting box 99.

Also shown (partially in section), is a spacer 71 for inclining the support frame 72 (and thus the table 74 and platform 80) relative to the base 20 about the pivot "P". The separator assembly 70 is not shown inclined in FIGS. 4 or 5. Although its detail could take many forms, in the illustrated embodiment, the spacer 71 includes a head having a "bullet-shape" and a pin end. Detents 83, 85 are provided in the support frame 72 and in the base 20 to receive the head and pin of the spacer, the base receiving the pin and the support receiving the head having the bullet shape.

Turning now to FIG. 5, the top view of the apparatus 100 shows a succession of electrical contacts 11, 11' to be separated disposed in the guide (feed) track 44, one contact piece about to be presented to the ejector 60 disposed above the circular table 74, the table mounted to rotate in the direction of the arrow (the platform 80 and guide members 50, 52 being shown in phantom for clarity.

The ejector member 60 comprises the ejector plate 61 mounted for reciprocal horizontal movement between first and second positions. The plate 61 defines a pair of guide fingers 62, 64 having their respective slanted tips 63,65 in faced relation, the tips together defining a slanted guideway 69 sized to pass one contact piece from an entry to an exit thereof. Initially, when the plate 61 is in the first position, the entry to the guideway is disposed in register with the outlet end 45 of the guide (feed) track 44. A contact piece is engaged by the slanted leading edge of one of the fingers, causing the contact to enter the guideway. As the plate is reciprocated, the contact piece is cammed through the guideway. When the plate 61 has been reciprocated to the second position, the guideway exit is disposed in register with the inlet 47 to the guide tube and the entry closed. The plate 61 is then reciprocated back to the first position and another contact piece engaged by the guide finger. The ejector would be operated at a generally constant rate (e.g., 100 pieces/min) to select one contact piece at a time for dropping into the supply tube 46.

FIG. 6 is an enlarged plan view of the guide members 50, 52. The guide members 50, 52 respectively comprise what could be characterized as a pair of wipers, each extending from the outlet 49 of the guide (supply) tube 46 and towards the center 75 of the circular table 74. The first guide member 50 has a free end 51 spaced from the radial wall 82 of the platform to define an aperture 54 through which the contact pieces may pass and a slanted edge 55 for guiding the contact pieces from the guide (supply) tube outlet 49 and with an impetus to the center of the table. The second guide member 52 has a first edge 53 spaced from the slanted edge 55 of the other guide member 50 and a second edge (or sidewall) 58, spaced from its first edge 53 for scraping damaged contacts from the tabletop. A distal end 57 of second guide member 52 is adjacent to the radial wall 82 and so spaced therefrom to prohibit contact pieces from passing therebetween as the result of a complete rotation of the table. A channel 56 is defined by the space between the slanted edge 55 of the first guide member 50 and the first edge 53 of the second guide member 52. This channel serves to direct the contact pieces onto the tabletop annulus and towards the table center.

FIG. 7 is an end view of the separating assembly showing the opening 86 between the tabletop 76 and platform surface 84 with a good contact piece 11 rolling into the opening and a deformed contact piece 11 having its socket 15 extending from the tabletop 76 a distance such that this contact piece cannot pass into the opening.

Operation

An assembler would adjust the table 74 to a tilt angle of approximately 5° by introduction of the appropriate spacer 71. The batch 200 of electrical contacts 11, 11' to be separated is disposed in the bowl 30 adjacent the inlet (receiving) end 43 of the guide (feed) track 44 which receives and orients the contact pieces stem down and supplies them in a side-by-side train to the ejector 60 positioned at the outlet end 45 of the feed track.

As the helical drum 32 is vibrated, the contact pieces are advanced from the bowl (or hopper) 30 to the inlet end 43 of the guide bar 42 and into the feed track 44, the agitator 90 causing the contact pieces to be advanced across the track to the outlet end 45 adjacent to to the ejector 60, the scanner 92 determining in connection with the agitator 38 whether the contacts are bunching up and activating the ejector 60 to push one contact into the guide (supply) tube 46. The guide tube 46 delivers the contacts to be tested to the annulus 88 of the rotating table 74. As a result of the table 74 rotating, the contacts are presented to the slanted edge 55 of the first guide member 50 and pass through the aperture 56. As the table continues to rotate, a good contact piece 11 would have a tendency to roll and would roll between the opening 86 between the table and platform, fall through one of the central annular holes 78 and down the slide surface 91 for collection by the first box 97. A deformed contact piece 11', on the other hand, would not roll as the table 74 rotates since the deformed portion would impede the rolling capability of the contact. This inability to roll would cause the bent and/or deformed contact to be rotated around and presented to the second (sidewall) edge 58 of the second guide 52 and scraped from the rim 77 of the table for collection by the second box 99.

While a preferred embodiment of the invention has been disclosed it will be apparent to those skilled in the art that changes may be made to the invention as set forth in the appended claims and, in some instances, certain features of the invention may be used to advantage without corresponding use of other features. Accordingly, it is intended that the illustrative and descriptive materials herein be used to illustrate the principles of the invention and not to limit the scope thereof.

We claim:

1. An apparatus (100) for sorting electrical contact pieces (11,11') of the type having an elongated body with a medial collar (14) and characterized that when placed on an inclined surface deformed ones of the contact pieces (11') will not roll sidewise and undeformed ones of the contact pieces (11) will roll sidewise, the apparatus characterized by:

a support frame (72);

a circular table (74) rotatably mounted to the support frame, the table having a center (75), an outer rim (77), a substantially flat tabletop (76) inclined to the horizon and a central hole (78) for discharging undeformed contact pieces from the tabletop;

a circular platform (80) concentrically mounted above the table, the platform having a substantially flat bottom surface (84) disposed in parallel, spaced-apart relation to the tabletop to define an opening (86) sized to receive undeformed ones of the contact pieces which roll therebetween and a radial wall (82), the diameter of the platform being less than that of the table so as to expose an annulus (88) on the tabletop between the rim and the radial wall; and a prime-mover (94) for continuously rotating the table.

2. An apparatus as required by claim 1 further comprising:

a guide tube (46) for directing each of the contact pieces onto the annulus (88) with an impetus toward the center of the tabletop; and a guide member (52) having an distal end (57) adjacent to the radial wall (82) and a sidewall (58) for scraping the deformed ones of the contact pieces from the table, whereby as the table rotates, the undeformed contact pieces (11) will tend to roll between the opening (86) and into the hole (78) and the deformed contact pieces (11') will not roll but are rotated around to the sidewall (58) and scraped over the rim of the table.

3. An apparatus as required by claim 2 further comprising an ejector (60) for supplying contact pieces one at a time to the guide tube (46) and a guide track (44) for orienting and for channelling the contact pieces in side-by-side relation from an inlet position adjacent to the batch and to an outlet position adjacent to the ejector.

4. An apparatus as required by claim 3 wherein the ejector (60) comprises a pair of guide fingers (62, 64) having their tips (63, 65) in faced relation and mounted for reciprocal horizontal movement between first and second positions, the tips defining a slanted guideway (69) sized to fit one contact piece, the guideway being in register with the guide track outlet when in the first position whereby a contact piece is engaged by one finger and moved into the guideway and out of register with the guide track outlet and in register with the tube inlet when in the second position.

5. An apparatus as required by claim 4 wherein guide member (52) includes a first edge (53) defining a first guidewall and further including a second guide member (50) having an inward end (51) spaced from the radial wall (82) to define an aperture (54) through which the contact pieces can pass when the table is rotated and a slanted edge (55) defining a second guidewall, the guidewalls (53, 55) disposed in faced relationship to define a channel (56) therebetween for directing the contact pieces onto the tabletop.

6. An apparatus as required by claim 1 wherein the central hole forms an annular opening.

7. An apparatus as required by claim 6 wherein a pair of annular openings of arcuate shape are disposed centrally of the table and table (74) is mounted for rotation at its center (75).

8. An apparatus as required by claim 1 wherein the table is rotated at less than 20 rev/min.

9. An apparatus as required by claim 8 wherein the table is rotated at about 15.5 rev/min.

10. An apparatus as required by claim 1 wherein the table is inclined at an angle of about 5°.

11. For a batch of electrical contact pieces (200) of the type having an axially extending elongated body (11) and a medial collar (14), the body portions of some pieces being deformed or otherwise unable to sidewise roll and of other pieces being undeformed and able to sidewise roll, an apparatus (100) for sorting characterized by:

a pair of concentric tables (74, 80) mounted one above the other with the first table (74) mounted for continuous angular rotation and having an outer periphery (77), a flat tabletop (76) and a central hole (78) for discharging contact pieces and the second table (80) disposed above the first table and including a flat bottom surface (84) facing the tabletop and spaced thereform in parallel relation to define a uniform opening (86) and sized to receive the other pieces and a radial wall (82) extending inwardly of the outer periphery (77) and superposing the hole therebetween;

a guide apparatus (40) including a pair of spaced guide member (50, 52), a channel (56) therebetween for directing the contact pieces onto the tabletop, one guide member (50) having an inward end (51) spaced from the radial wall to define a passage (54) therebetween sized to pass the pieces presented to the tabletop (76), the other guide member (52) having an inward distal end (57) adjacent to the radial wall and sized to prohibit pieces from passing therebetween and a sidewall edge (58) adapted to scrape the contact pieces from the tabletop; and a prime-mover (94) for continuously rotating the table whereby as the contact pieces to be sorted are presented to the tabletop and as said table is rotated from the channel around to the sidewall, the deformed pieces do not roll and do not slide between the opening as the table is rotated and the sidewall scrapes them from the tabletop whereas the undeformed pieces will roll between the opening and slide into the hole and be discharged through the tabletop.

12. An apparatus as required by claim 11 comprising a guide tube (46) having an inlet (47) at a higher level than the tabletop and an outlet (49) adjacent to the tabletop;

an ejector apparatus (60) disposed adjacent to the tube (46) for supplying contact pieces one at a time to the tube inlet; and a guide track (44) for orienting the contact pieces and for channelling the contact pieces in side-by-side relation from an loading inlet end (43) adjacent to the batch and to an unloading outlet end (45) adjacent to the ejector.

13. An apparatus (100) for sorting a batch of electrical contact pieces (11, 11') into two groups, each of the contact pieces being of the type having a medial collar (14), a socket (15) extending forwardly of the collar and an elongated stem (16) extending rearwardly of the collar, the first group consisting of contact pieces (11) free to roll when disposed sidewise on a flat surface and the second group consisting of contact pieces (11') having bent portions or otherwise not free to roll on a flat surface sidewise, the apparatus characterized by:

a tiltable support frame (72);

a continuously rotatable table (74) mounted to the frame and having a flat tabletop (76) inclined at an angle to the horizon for receiving the contact pieces from the batch, said tabletop having a hole (78) extending therethrough and adapted to receive contact pieces of the first group that roll therein;

a circular platform (80) mounted above the tabletop and coaxially about its center with the axis of rotation of the table and having a flat bottom surface (84) mounted in parallel, spaced-apart relationship from the tabletop (76) and a radial wall (82), said tabletop and bottom surface defining an opening (86) therebetween sized to accept contact pieces (11) of the first group;

a first guide member (50) for directing contact pieces from the batch to the tabletop and having a distal end (51) spaced from the radial wall of the platform to define a passage (54) sized to pass each of the contact pieces when the table is rotated;

a second guide member (52) having a sidewall edge (58) and an end portion (57) in close proximity to the radial wall of the platform and sized to prohibit passage of contact pieces; and a prime mover (94) for rotating the table, whereby as the contact pieces are directed onto the tabletop, the contact pieces are rotated through the passage, the first group of contacts being free to roll and slide through the opening and into the hole, the second group of contact pieces not being allowed to pass through the opening do not roll or slide into the opening and are rotated by the table around to the sidewall and thereby removed from the table.

14. Apparatus (100) for sorting a batch (200) of electrical contact pieces (11, 11') each of the pieces being of the type having a medial collar (14), a socket (15) extending forwardly of the collar and an elongated stem (16) extending rearwardly of the collar, said apparatus having:

a separator assembly (70) for separating the contact pieces into two groups, a first group consisting of contact pieces (11) having their body portions axially aligned and free to roll sidewise and a second group consisting of contact pieces (11') having their body portions misaligned and not free to roll sidewise, and a guide apparatus (40) for receiving contact pieces from the batch and for directing the pieces stem first to the separator assembly, characterized in that said separator assembly comprises:

a tiltable support frame (72);

a table (74) rotatably mounted to the support frame and having a flat top surface (76) for receiving the contact pieces and a hole (78) extending therethrough sized to pass contact pieces (11) of the first group;

a circular platform (80) mounted above the top surface of the table with its center coaxial with the axis of rotation of the table and having a radial wall (82) and a flat bottom surface (84) mounted in substantially parallel, spaced-apart relation above the top surface of the table to define a uniform opening (86) therebetween;

a prime-mover (94) for continuously rotating the table about its axis;

a first arrangement (96) for collecting the contact pieces from the table that passed through the hole in the table; and a second arrangement (98) for collecting the second group of contacts scraped from the table, further characterized in that said guide apparatus (40) comprises;

a guide member (50) for deflecting the contact pieces onto the tabletop when the table is rotated and cooperating with the radial wall to define a passage (54) through which the contact pieces will pass when the table is rotated;

a second guide member (50) having a sidewall (58) adapted to direct the contact pieces from the tabletop, said guide members (50, 52) being disposed in spaced relation to define a channel (56) therebetween;

whereby as said table is rotated and as the contact pieces to be separated are guided from the batch and onto the table, the the first group of contacts roll or slide between the opening table to be discharged through the hole and whereas the second group of pieces do not roll but are rotated around and to the sidewall and scraped off the table.

15. An apparatus as required in claim 14 wherein the guide apparatus further comprises:

a guide tube (46) having an inlet (47) and an outlet (49) opening into said channel;

a guide track (44) for orienting the contact pieces and for channelling the pieces in side-by-side relation from a loading position adjacent to the batch and to an unloading position;

a pair of guide fingers (62, 64) having slanted edges (63, 65) disposed in spaced apart relation, the edges defining a guideway (69) therebetween sized to receive one contact piece and mounted for horizontal reciprocation between first and second positions, the first position registering the guideway with the unloading track outlet, such that by reciprocation of the fingers to the second position a contact piece is moved into and through the guideway and the guideway registered with the guide tube inlet.

16. A method of sorting contact pieces (11) of the type having coaxially aligned head (12), collar (14) and tail (16) portions from contact pieces (11') having bent or deformed portions, characterized by the steps of:

providing a non-rotatably mounted first circular platform (80) in spaced relation to a rotatably mounted second circular platform (72), the spaced relation defining an opening (86) therebetween inclined at an angle to the horizon and sized to pass the coaxial contact pieces (11), the second platform having a central hole (78) and a diameter greater than the first platform diameter to define an annulus (88) for receiving contacts;

positioning the contact pieces (11, 11') above the second platform (72);

supplying the pieces, one at a time, to the second platform disposed there below; and continuously rotating the second platform relative to the first platform, the undeformed contacts passing between the opening and through the hole.

17. A method of sorting contact pieces (11) of the type having coaxially aligned head (12), collar (14) and tail (16) portions from contact pieces (11') having bent or deformed portions, characterized by the steps of:

providing a separator member (70) of the type including a first circular platform (80) non-rotatably mounted in spaced relation to a second rotatably mounted circular platform (72), the spaced relation defining an opening (86) therebetween sized to pass the coaxial contact pieces (11), the second platform having a central hole (78) and a diameter greater than the first platform diameter to define an annulus (88) for receiving contacts, inclining the separator member at an angle to the horizon, positioning the contact pieces (11, 11') above the second platform (72), supplying the pieces, one at a time, to the separator member (70) disposed therebelow, and continuously rotating the second platform relative to the first platform whereby the undeformed contacts (11) pass between the opening and through the hole.

18. A method as required in claim 17 wherein the positioning step includes placing the contact pieces on a track (44) in side-by-side relation to form a succeeding train with their tail portions (16, 16') directed down, and further comprising the step of feeding the train of pieces to an ejector (60), said ejector being adapted to eject the contacts from the train one at a time to be supplied to the separator.

19. A method as required in claim 18 further including the steps of:

interposing a guide tube (46) between the ejector (60) and the annulus (88), said tube being adapted to direct the contact pieces from the ejector and onto the annulus, and providing a pair of guide members (50, 52) adjacent the discharge end of the guide tube to direct the contact pieces towards the center of the second platform.

* * * * *